US005575122A

United States Patent [19]

Hamilton et al.

[11] Patent Number: 5,575,122

[45] Date of Patent: Nov. 19, 1996

[54] EARTH SCREW ANCHOR ASSEMBLY HAVING ENHANCED PENETRATING CAPABILITY

[75] Inventors: Daniel V. Hamilton; Robert M. Hoyt, both of Centralia; Patricia J. Halferty, Columbia; William L. Hoffman, Centralia, all of Mo.

[73] Assignee: Hubbell Incorporated, Orange, Conn.

[21] Appl. No.: 561,908

[22] Filed: Nov. 22, 1995

[51] Int. Cl.[6] ..... E02D 5/74

[52] U.S. Cl. ..... 52/157; 52/153; 52/160; 52/162; 405/253

[58] Field of Search ..... 52/157, 158, 160, 52/161, 162, 163; 175/388, 394; 405/253

[56] References Cited

U.S. PATENT DOCUMENTS

| | | | |
|---|---|---|---|
| Re. 32,076 | 2/1986 | Dzidzic | 405/303 |
| 4,334,392 | 6/1982 | Dziedzic | 52/157 |
| 4,467,575 | 8/1984 | Dziedzic | 52/157 |
| 4,742,656 | 5/1988 | Farmer | 52/155 |
| 4,981,000 | 1/1991 | Hamilton et al. | 52/157 |
| 5,113,626 | 5/1992 | Seider et al. | 52/157 |
| 5,408,788 | 4/1995 | Hamilton et al. | 52/157 |

*Primary Examiner*—Carl D. Friedman
*Assistant Examiner*—Yvonne Horton-Richardson
*Attorney, Agent, or Firm*—Jerry M. Presson; Michael R. Swartz

[57] ABSTRACT

An earth screw anchor assembly has peripheral edges on its hub member and intermediate flange portion of its spade member with different configurations permitting placement of the hub member on the intermediate flange portion in an asymmetrical relation overlapping and offsetting the respective peripheral edges relative to one another to facilitate application of welds thereto for attaching the hub member to the spade member. The assembly also has an attachment land formed on one side of the intermediate flange portion and protruding downwardly therefrom and being attached along and extending partially about an upper end of the lower portion of the spade member. The blade member includes leading and trailing end portions axially offset from one another and a middle portion extending between the leading and trailing end portions. The blade member at the trailing end and middle portions is attached to the hub member while the leading end portion thereof extends below and along the intermediate flange portion and is attached to the attachment land of the spade member so as to dispose the leading end portion of the blade member substantially below the intermediate flange portion and thereby below the lower end of the hub member such that the leading end portion of the blade member will engage and dig into the earth as the assembly is rotated about the longitudinal axis of said spade member before contact is made with the earth by the intermediate flange portion of the spade member and thereafter by the hub member.

24 Claims, 3 Drawing Sheets

EARTH SCREW ANCHOR ASSEMBLY HAVING ENHANCED PENETRATING CAPABILITY

BACKGROUND OF THE INVENTION

1. Field of the Invention

The present invention generally relates to earth screw anchors and, more particularly, is concerned with an earth screw anchor assembly having components which are designed to coordinate with and complement one another so as to facilitate construction of an earth screw anchor having enhanced structural integrity and enhanced capability to penetrate difficult earth conditions.

2. Description of the Prior Art

A variety of earth screw anchors have been designed for use by utilities to secure various components or structures, such as guy wires and the like, to the earth. Such earth anchors are typically powered by a drive tool for turning the anchor into secure confinement within the ground. Thus, the earth screw anchor is adapted to be driven by a source of rotational driving force into unbroken soil.

Representative examples of earth screw anchors are disclosed in U.S. Pat. Nos. 4,334,392, 4,467,575 and Re. 32,076 to Dziedzic, U.S. Pat. No. 4,981,000 to Hamilton et al, U.S. Pat. No. 5,113,626 to Seider et al and U.S. Pat. No. 5,400,788 to Hamilton et al, all of which are assigned to the assignee of the present invention. Another earth screw anchor is disclosed in U.S. Pat. No. 4,742,656 to Farmer. These earth screw anchors basically include a longitudinally extending hub, a helical blade, and a lead tip or point. The hub has upper and lower opposite axial ends and a recess provided in the upper axial end by which the anchor may be engaged and rotatably driven by the drive tool. The helical blade, which becomes the load-bearing element of the buried anchor, is affixed to and extends about and radially outwardly from the hub between the axial ends thereof. The lead point, which is the initial earth engaging and penetrating element of the anchor, extends from the lower axial end of the hub. In the above-cited U.S. Pat. No. 5,408,788 to Hamilton et al, the lead point takes the form of a spade point having a pair of opposite leading and trailing edges which converge toward one another and merge into an end tip.

The above-identified earth screw anchors work well in the typical moderate earth conditions most commonly encountered. However, many of these constructions experience difficulty in penetrating the earth in severe conditions, such as frozen or very dense soil. Consequently, a need remains for improvements in the design and construction of earth screw anchors which will provide improved earth penetration capability.

SUMMARY OF THE INVENTION

The present invention provides an earth screw anchor assembly designed to satisfy the aforementioned needs. The earth screw anchor assembly of the present invention has components which are designed to coordinate with and complement one another so as to facilitate construction of an anchor having enhanced structural integrity and also enhanced capability to penetrate the more difficult earth conditions.

Accordingly, the present invention is directed to an earth screw anchor assembly which comprises an elongated hollow tubular hub member, a spade member and a blade member. The hub member has a pair of upper and lower opposite ends axially spaced apart along a central axis of the hub member. The spade member has a longitudinal axis and includes an upper portion inserted in the hub member from a lower open end thereof, a lower portion connected to the upper portion and extending downwardly therefrom and from the lower end of the hub member and adapted to cut and penetrate into the earth upon rotation of the assembly about the longitudinal axis, and an intermediate flange portion attached about the upper and lower portions at the location of connection therebetween and extending radially outwardly from the longitudinal axis and beyond the upper and lower portions and providing a support seating the lower end of the hub member. The lower end of the hub member and the intermediate flange portion of the spade member have respective peripheral edges thereon that provide adjacent surfaces to which welds are applied for attaching the lower end of the hub member to the intermediate flange portion of the spade member. The blade member is helical in shape and extends about and radially outwardly from the hub member and is attached to the hub member so as to adapt the blade member to engage and dig into the earth as the assembly is rotated about the longitudinal axis of the spade member.

More particularly, the respective peripheral edges of the lower end of the hub member and the intermediate flange portion of the spade member having different configurations permitting placement of the hub member on the intermediate flange portion of the spade member in an asymmetrical relationship therewith so as to overlap and offset the respective peripheral edges relative to one another and thereby place in angularly displaced abutting relationships respective surfaces on the respective peripheral edges to which the welds are applied attaching the lower end of said hub member to the intermediate flange portion of the spade member.

Still further, an attachment land is formed on one side of the intermediate flange portion to protrude downwardly therefrom. The attachment land is attached along and extends partially about an upper end of the lower portion of the spade member. The blade member includes a pair of leading and trailing opposite end portions being axially offset from one another along the central axis of the hub member and a middle portion extending between the leading and trailing opposite end portions. The trailing end portion and middle portion of the helical blade member are attached to the hub member, whereas the leading end portion of the helical blade member extends below the intermediate flange portion of the spade member along and attached to the attachment land thereof so as to dispose the leading end portion of the blade member substantially below the intermediate flange portion and thereby below the lower end of the hub member. Thus, the leading end portion of the blade member will engage and dig into the earth as the assembly is rotated about the longitudinal axis of the spade member before contact is made with the earth by the intermediate flange portion of the spade member and thereafter by the hub member.

Still further, the hub member has a maximum dimension extending transverse to its central axis. The lower portion of the spade member has a pair of diametrically opposite leading and trailing cutting edges extending at respective acute angles relative to the longitudinal axis and displaced by a maximum dimension extending transverse to the longitudinal axis which is at least as large as the maximum transverse dimension of the hub member. Thus, a hole dug in the earth by the rotation of the lower portion of the spade member will be large enough to receive the hub member therein.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 3:
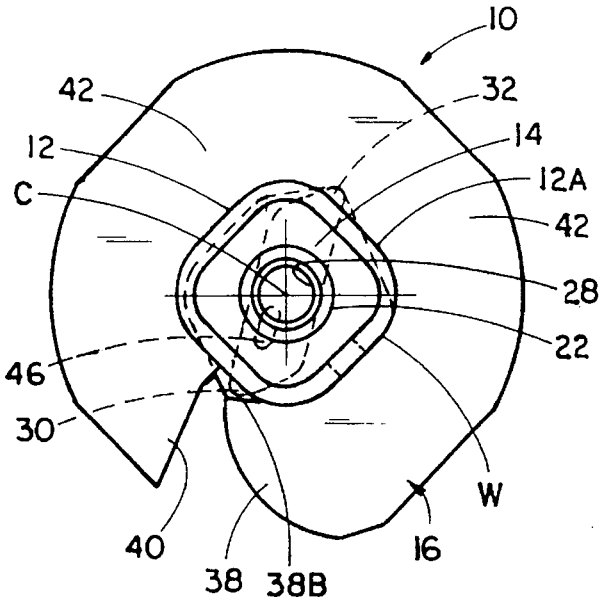
FIG. 3 is a top plan view of the assembly as seen along line 3—3 of FIG. 1.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 2:
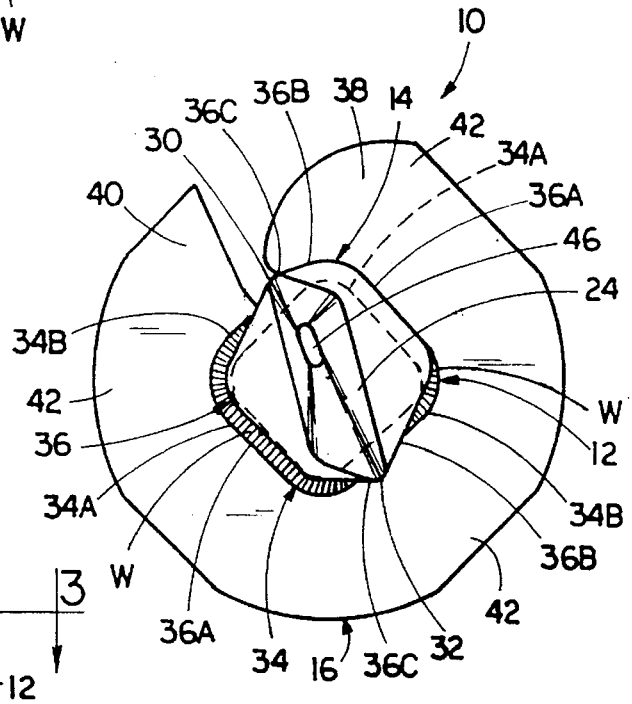
FIG. 2 is a bottom plan view of the assembly as seen along line 2—2 of FIG. 1.
Figure 1:
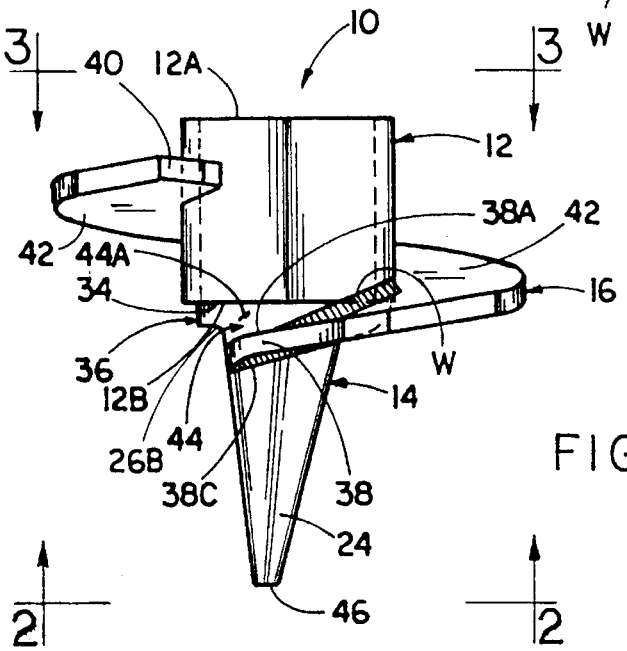
FIG. 1 is a side elevational view of an earth screw anchor assembly in accordance with the present invention.

Referring now to the drawings, and particularly to FIGS. 1–3, there is illustrated an earth screw anchor assembly of the present invention, being generally designated by the numeral 10. As will be described in detail hereinafter, the earth screw anchor assembly 10 has separate components which are designed to coordinate with and complement one another so as to facilitate construction of an anchor having enhanced structural integrity and also enhanced capability to penetrate the more difficult earth conditions. The assembly 10 basically comprises an elongated hollow tubular hub member 12, a spade member 14, and a blade member 16 which are fabricated of a suitable rigid material and interfitted and then welded together to form the finished earth screw anchor.

Referring to FIGS. 1–3, 7 and 8, the elongated hollow tubular hub member 12 of the assembly 10 has a central axis C and a pair of upper and lower opposite open ends 12A, 12B axially spaced apart along the central axis C. In the exemplary embodiment, the hub member 12 has a substantially rectangular configuration and includes first and second pairs of opposing sidewalls 18, 20 being rigidly connected along their respective opposite ends which extend parallel to the central axis C. Alternatively, the hub member 12 can be provided in other configurations.

Referring to FIGS. 1–6, the spade member 14 of the assembly 10 has a longitudinal axis L and includes an upper portion 22 inserted in the hub member 12 through the lower open end 12B thereof, a lower portion 24 integrally connected to the upper portion 22 and extending downwardly therefrom and from the lower end 12B of the hub member 12, and an intermediate flange portion 26 attached about the upper and lower portions 22, 24 at the location of integral connection therebetween and extending radially outwardly from the longitudinal axis L and beyond the upper and lower portions 22, 24.

More particularly, the upper portion 22 of the spade member 14 is preferably cylindrical in configuration and has attachment means 28, such as a threaded hole defined therein downward from the upper end 22A of the upper portion 22 to which is attached a connector rod (not shown), for facilitating attachment of the spade member 14 and thus the assembly 10 to a conventionally well-known drive tool (not shown) which cooperates with the interior of the hollow hub member 12 for causing rotation of the assembly 10 about the longitudinal axis L to implant the assembly 10 in the earth. Once the assembly 10 is implanted in the earth, the drive tool is removed and a guy wire nut (not shown) for connection of a guy wire is attached to the opposite free end of the connector rod in a conventional manner.

The lower portion 24 of the spade member 14 has an overall tapered configuration with a pair of diametrically opposite leading and trailing cutting edges 30, 32 thereon which extend at respective different acute angles relative to the longitudinal axis L of the spade member 14. The leading and trailing edges 30, 32 are adapted to cut and penetrate into the earth upon rotation of the assembly 10 about the longitudinal axis L by the drive tool. The hub member 12 has a maximum dimension extending transverse to its central axis C between diametrically opposite corners formed by its first and second pairs of sidewalls 18, 20. The lower portion 24 of the spade member 14 has a maximum dimension extending transverse to the longitudinal axis L and between the leading and trailing edges 30, 32 of the spade member 14 and located adjacent to the intermediate flange portion 26 thereof. The maximum transverse dimension of the lower portion 24 of the spade member 14 is at least as large as the maximum transverse dimension of the hub member 12 so that the hole dug in the earth by the lower portion 24 of the spade member 14 will be large enough to receive the hub member 12 therein without the hub member 12 presenting an obstacle to the effective burial of the anchor assembly 10 in the earth.

Figure 5:
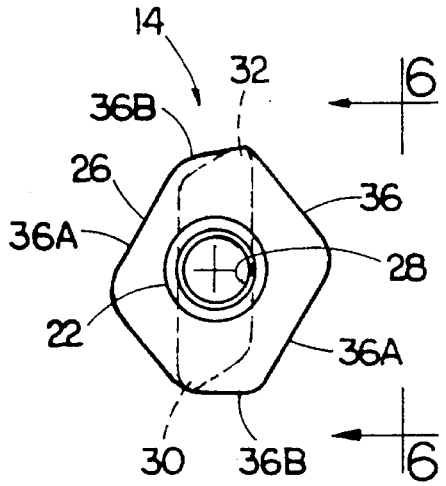
FIG. 5 is a top plan view of the spade member as seen along line 5—5 of FIG. 4.
Figure 6:
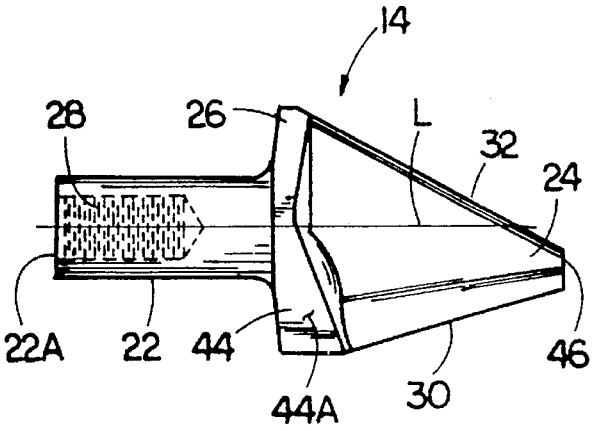
FIG. 6 is a side elevational view of the spade member as seen along line 6—6 of FIG. 5.
Figure 4:
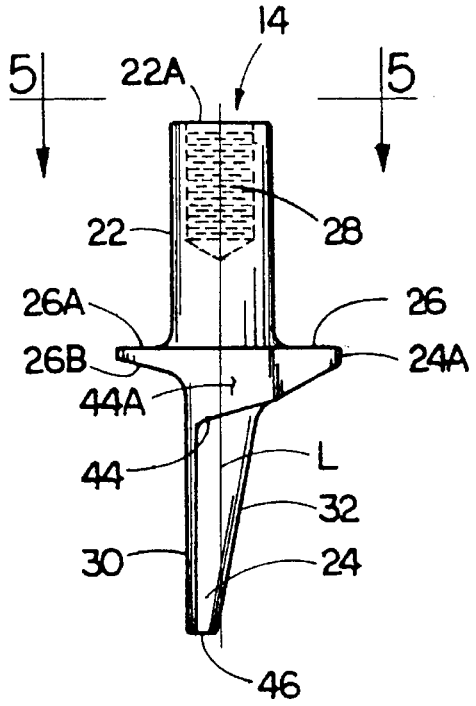
FIG. 4 is a front elevational view of a spade member of the assembly of FIG. 1.
Figure 8:
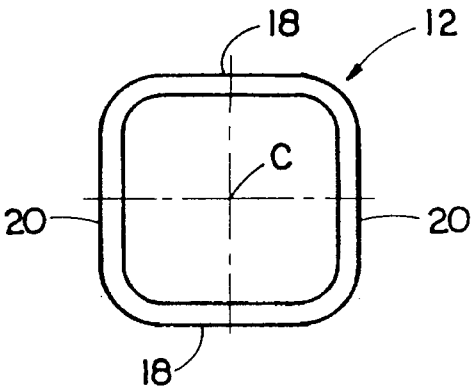
FIG. 8 is a top plan view of the hub member as seen along line 8—8 of FIG. 7.
Figure 7:
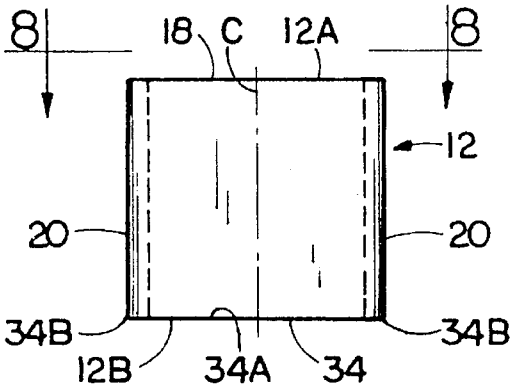
FIG. 7 is a side elevational view of a hub member of the assembly of FIG. 1.
Figure 10:
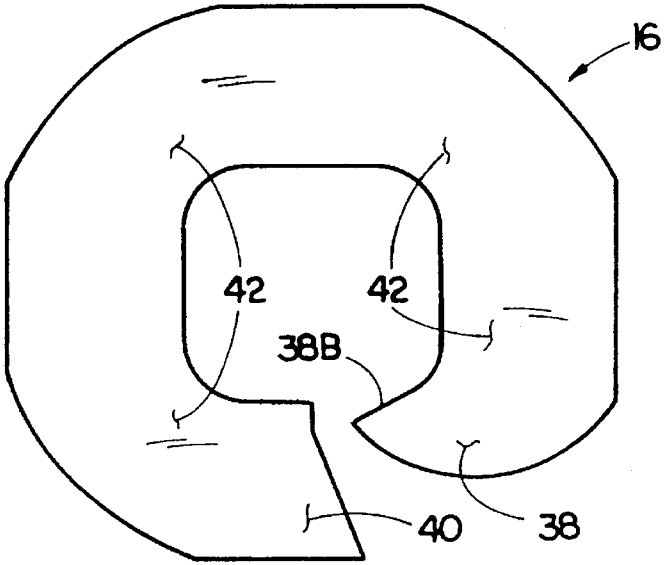
FIG. 10 is a top plan view of the blade member as seen along line 10—10 of FIG. 9.
Figure 9:
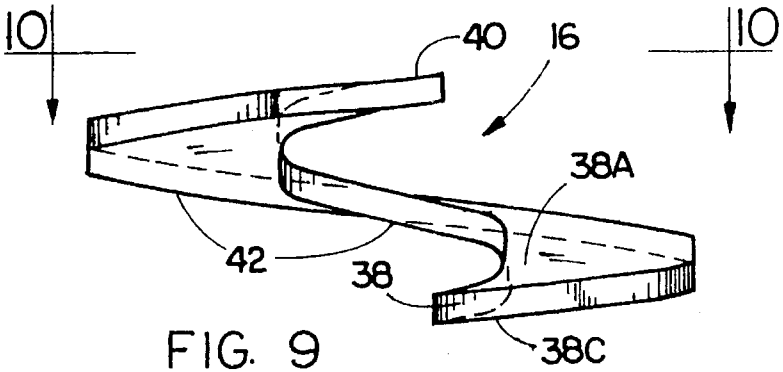
FIG. 9 is a side elevational view of a blade member of the assembly of FIG. 1.

Further, as best seen in FIGS. 1–3, the lower end 12B of the hub member 12 and the intermediate flange portion 26 of the spade member 14 have respective peripheral edges 34, 36 thereon with different configurations which permit the placement of the hub member 12 upon a top surface 26A of the intermediate flange portion 26 of the spade member 14 in an asymmetrical relationship therewith so as to overlap and offset the respective peripheral edges 34, 36 relative to one another. The placement of the respective peripheral edges 34, 36 in such asymmetrical relationship provides the surfaces thereon in angularly displaced abutting relationships defining corners between the components into which welds W are applied to rigidly attach the lower end 12B of the hub member 12 to the intermediate flange portion 26 of the spade member 14. As seen in FIGS. 7 and 8, the lower peripheral edge 34 on the lower end 12B of the hub member 12 has first and second pairs of opposing edge portions 34A, 34B arranged in the substantially rectangular configuration of the hub member 12 such that the opposing edge portions 34A of the first pair extend in substantially transverse relationship to the opposing edge portions 34B of the second pair. On the other hand, as seen in FIGS. 4–6, the peripheral edge 36 of the intermediate flange portion 26 of the spade member 14 includes first and second pairs of opposite edge portions 36A, 36B. The opposite edge portions 36A of the first pair thereof on the peripheral edge 36 of the intermediate flange portion 26 of the spade member 14 are closer to one another than are the opposing edge portions 34A of the first pair thereof on the peripheral edge 34 of the hub member 12. Conversely, the opposite edge portions 36B of the second pair thereof on the peripheral edge 36 of the intermediate flange portion 26 of the spade member 14 are farther apart from one another at their extreme points 36C than are the opposing edge portions 34B of the second pair thereof on the peripheral edge 34 of the hub member 12.

Referring to FIGS. 1–3, 9 and 10, the blade member 16 of the assembly 10 is the load bearing element of the assembly 10 once it is buried in the earth and connected to a guy wire. The blade member 16 is substantially helical in shape and extends about and radially outwardly from the hub member 12 and is attached to the hub member 12 and spade member 14 so as to adapt the blade member 16 to contact and dig into the earth as the assembly 10 is rotated about the longitudinal axis L of the spade member 14.

More particularly, the blade member 16 includes a pair of leading and trailing opposite end portions 38, 40 being axially offset from one another along the central axis C of the hub member 12 and a middle portion 42 extending between the leading and trailing end portions 38, 40. The blade member 16, at its inner periphery along its trailing end portion 40 and middle portion 42, is attached by welds to the hub member 12.

For facilitating attachment of the blade member 16 to the spade member 14, as best seen in FIGS. 1, 4 and 6, the spade member 14 includes an enlarged section in the form of an attachment land 44 formed on one side of the intermediate flange portion 26 which protrudes downwardly therefrom and also is arcuate shaped so as to extend partially about and integrally attach to an upper end 24A of the lower portion 24 of the spade member 14. The blade member 16 at its leading end portion 38 extends in an inclined manner below the intermediate flange portion 26 and along and is attached to the attachment land 44 of the spade member 14 so as to thereby dispose the leading end portion 38 of the blade member 16 substantially below the intermediate flange portion 26. Thus, the leading end portion 38 of the blade member 16 is also disposed below the lower end 12B of the hub member 12 such that the leading end portion 38 of the blade member 16 will always contact and dig into the earth as the assembly 10 is rotated about the longitudinal axis L of the spade member 14 before any contact is made with the earth by the intermediate flange portion 26 of the spade member 14 and thereafter by the hub member 12.

More particularly, the attachment land 44 on the spade member 14 protrudes downwardly from the intermediate flange portion 26 below the elevation of a bottom surface 26B thereof and at an opposite side thereof. As seen in FIG. 1, the blade member 16 at its leading end portion 38 has an upper surface 38A disposed substantially at the same elevation as the bottom surface 26B on the intermediate flange portion 26 at the opposite side thereof. Further, the attachment land 44 has an exterior surface 44A facing outwardly therefrom and the leading end portion 38 of the blade member 16 has an interior surface 38B (FIG. 10) facing inwardly therefrom toward and in flush contact with the exterior surface 44A of the attachment land 44 so as to provide the spaced upper and lower surfaces 38A, 38C of the leading end portion 38 of the blade member 16 in angularly displaced abutting contact with the exterior surface 44A for facilitating the application of welds thereto for attaching the leading end portion 38 of the blade member 16 to the attachment land 44 on the spade member 14.

In addition, the leading and trailing cutting edges 30, 32 of the lower portion 24 of the spade member 14 converge together into a lower point 46 being offset from the longitudinal axis L of the spade member 14. The attachment land 44 which extends partially about the upper end 24A of the lower portion 24 of the spade member 14 and the leading end portion 38 of the blade member 16 both terminate at the leading cutting edge 30 on the lower portion 24 of the spade member 14.

It can be readily observed and understood that above-described arrangement of the blade member 16 about and attachment thereof to both the hub member 12 and spade member 14 rigidly ties the components together and thereby provides an improved anchor of enhanced structural integrity.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. An earth screw anchor assembly, comprising:

(a) an elongated hub member having a pair of upper and lower opposite ends axially spaced apart along a central axis;

(b) a spade member having a longitudinal axis and including an upper portion disposed in said hub member and a lower portion extending downwardly therefrom and from said lower end of said hub member and adapted to cut and penetrate into the earth upon rotation of said assembly about said longitudinal axis; and (c) a blade member being helical in shape and extending about and radially outwardly from said hub member, said blade member having a pair of leading and trailing opposite end portions being axially offset from one another along said central axis of said hub member with said leading end portion being disposed on said lower portion of said spade member below said lower end of said hub member and said trailing end portion being disposed on an upper end portion of said hub member above said lower end such that said leading end portion of said blade member will engage and dig into the earth before contact is made with the earth by said lower end of said hub member as said assembly is rotated about said longitudinal axis of said spade member.

2. The assembly as recited in claim 1, wherein said spade member further includes an intermediate flange portion attached about said upper and lower portions about a location of connection therebetween, said intermediate flange portion extending radially outwardly from said longitudinal axis of said upper portion and beyond said upper and lower portions so as to provide a support for said hub member at said lower end thereof.

3. The assembly as recited in claim 2, wherein said lower end of said hub member and said intermediate flange portion of said spade member have respective peripheral edges of different configurations permitting placement of said hub member on said intermediate flange portion of said spade member in an asymmetrical relationship therewith so as to overlap and offset said respective peripheral edges relative to one another and thereby place in angularly displaced abutting relationships respective surfaces on said respective peripheral edges to which welds are applied attaching said lower end of said hub member to said intermediate flange portion of said spade member.

4. The assembly as recited in claim 3, wherein said peripheral edge of said lower end of said hub member includes first and second pairs of opposing edge portions.

5. The assembly as recited in claim 4, wherein said first and second pairs of opposing edge portions of said peripheral edge of said lower end of said hub member are arranged in a substantially rectangular configuration.

6. The assembly as recited in claim 4, wherein said opposing edge portions of said first pair extend in substantially transverse relationship to said opposing edge portions of said second pair.

7. The assembly as recited in claim 4, wherein said peripheral edge of said intermediate flange portion of said spade member includes first and second pairs of opposite edge portions.

8. The assembly as recited in claim 7, wherein said opposite edge portions of said first pair thereof on said peripheral edge of said intermediate flange portion of said spade member are closer to one another than are said opposing edge portions of said first pair thereof on said peripheral edge of said hub member.

9. The assembly as recited in claim 7, wherein said opposite edge portions of said second pair thereof on said peripheral edge of said intermediate flange portion of said spade member are farther apart from one another at extreme points thereon than are said opposing edge portions of said second pair thereof on said peripheral edge of said hub member.

10. The assembly as recited in claim 1, wherein:

said hub member has a maximum dimension extending transverse to said central axis; and said lower portion of said spade member has a maximum dimension extending transverse to said longitudinal axis being at least as large as said maximum transverse dimension of said hub member.

11. The assembly as recited in claim 1, wherein said upper portion of said spade member defines said longitudinal axis and is inserted into said hub member from said lower end thereof.

12. The assembly as recited in claim 1, wherein said upper portion of said spade member has attachment means to facilitate attachment of said spade member to a drive tool for rotating said assembly about said longitudinal axis to implant said assembly in the earth and then to connect to a guy wire once said assembly is implanted in the earth.

13. An earth screw anchor assembly, comprising:

(a) an elongated hollow tubular hub member having a central axis and a pair of upper and lower opposite open ends axially spaced apart along said central axis;

(b) a spade member having a longitudinal axis and including (i) an upper portion inserted into said hub member from said lower open end thereof, (ii) a lower portion connected to said upper portion and extending downwardly therefrom and from said hub member and adapted to cut and penetrate into the earth upon rotation of said assembly about said longitudinal axis, (iii) an intermediate flange portion attached about said upper and lower portions at a location of connection therebetween, said intermediate flange portion extending radially outwardly from said longitudinal axis and beyond said upper and lower portions such that respective peripheral edges on said lower end of said hub member and said intermediate flange portion of said spade member provide adjacent surfaces to which welds are applied for attaching said lower end of said hub member to said intermediate flange portion of said spade member, and (iv) an attachment land formed on one side of said intermediate flange portion and protruding downwardly therefrom and being attached along and extending partially about an upper end of said lower portion of said spade member; and (c) a blade member helical in shape and extending about and radially outwardly from said hub member, said blade member including (i) a pair of leading and trailing opposite end portions being axially offset from one another along said central axis of said hub member, and (ii) a middle portion extending between said leading and trailing opposite end portions, said blade member at said trailing end portion and said middle portion thereof being attached to said hub member, said blade member at said leading end portion thereof extending below said intermediate flange portion and along and attached to said attachment land of said spade member so as to dispose said leading end portion of said blade member substantially below said intermediate flange portion and thereby below said lower end of said hub member such that said leading end portion of said blade member will engage and dig into the earth as said assembly is rotated about said longitudinal axis of said spade member before contact is made with the earth by said intermediate flange portion of said spade member and thereafter by said hub member.

14. The assembly as recited in claim 13, wherein said attachment land protrudes downwardly from said intermediate flange portion below the elevation of a bottom surface thereof and at an opposite side of said intermediate flange portion.

15. The assembly as recited in claim 14, wherein said blade member at said leading end portion thereof has an upper surface disposed substantially at the same elevation as said bottom surface on said intermediate flange portion at said opposite side thereof.

16. The assembly as recited in claim 14, wherein said attachment land has an exterior surface facing outwardly therefrom and said leading end portion of said blade member has an interior surface facing inwardly therefrom toward and in flush contact with said exterior surface of said attachment land and spaced upper and lower surfaces in angularly displaced abutting contact therewith to which welds are applied attaching said leading end portion of said blade member to said attachment land.

17. The assembly as recited in claim 13, wherein said lower portion of said spade member includes a leading edge extending at an acute angle to said longitudinal axis and adapted to cut and penetrate into the earth upon rotation of said assembly about said longitudinal axis.

18. The assembly as recited in claim 17, wherein said leading edge of said lower portion of said spade member terminates in a lower point being offset from said longitudinal axis of said spade member.

19. The assembly as recited in claim 17, wherein said attachment land extends partially about an upper end of said lower portion of said spade member and terminates at said leading edge thereon.

20. The assembly as recited in claim 13, wherein said respective peripheral edges on said lower end of said hub member and said intermediate flange portion of said spade member have different configurations permitting placement of said hub member on said intermediate flange portion of said spade member in an asymmetrical relationship therewith so as to overlap but offset said respective peripheral edges relative to one another and thereby place in angularly displaced abutting relationships respective surfaces on said respective peripheral edges to which welds are applied for attaching said lower end of said hub member to said intermediate flange portion of said spade member.

21. The assembly as recited in claim 13, wherein:

said hub member has a maximum dimension extending transverse to said central axis; and said lower portion of said spade member has a maximum dimension extending transverse to said longitudinal axis being at least as large as said maximum transverse dimension of said hub member.

22. An earth screw anchor assembly, comprising:

(a) an elongated hollow tubular hub member having a pair of upper and lower opposite ends axially spaced apart along a central axis, said hub member having a maximum dimension extending transverse to said central axis;

(b) a spade member including (i) an upper portion having a longitudinal axis and being disposed in said hub member, said upper portion being adapted to facilitate attachment of said spade member to a drive tool for rotating said assembly about said longitudinal axis to implant said assembly in the earth and then to attach to a guy wire once said assembly is implanted in the earth, (ii) a lower portion connected to said upper portion and extending downwardly therefrom and from said hub member and being adapted to cut and penetrate into the earth upon rotation of said assembly about said longitudinal axis, said lower portion having a pair of diametrically opposite leading and trailing edges extending at respective acute angles relative to said longitudinal axis and displaced by a maximum dimension extending transverse to said longitudinal axis at least as large as said maximum transverse dimension of said hub member, and (iii) an intermediate flange portion attached about said upper and lower portions at a location of connection therebetween, said intermediate portion having a land formed on one side thereof which protrudes downwardly therefrom and extends partially about an upper end of said lower portion of said spade member; and (c) a blade member being helical in shape and having a pair of leading and trailing opposite end portions being axially offset from one another along said central axis of said hub member, said blade member extending about said upper end of said lower portion of said spade member and about said hub member with said leading end portion terminating on said land of said intermediate flange portion below said lower end of said hub member and said trailing end portion terminating on an upper portion of said hub member above said lower end thereof such that said leading end portion of said blade member engages and digs into the earth before said lower end of said hub member contacts said earth as said assembly is rotated about said longitudinal axis of said spade member.

23. The assembly as recited in claim 22, wherein said leading edge of said spade member and said leading end portion of said blade member are in vertical alignment.

24. The assembly as recited in claim 22, wherein said intermediate flange portion extends radially outwardly from said longitudinal axis and beyond said upper and lower portions such that respective peripheral edges on said lower end of said hub member and said intermediate flange portion of said spade member provide adjacent surfaces to which welds are applied for attaching said lower end of said hub member to said intermediate flange portion of said spade member.

* * * * *